US006484991B2

(12) United States Patent
Sher

(10) Patent No.: US 6,484,991 B2
(45) Date of Patent: Nov. 26, 2002

(54) HANGER SUPPORT WITH VERTICALLY DISPOSED GARMENT HANGING GROVES

(76) Inventor: Yuh Yi Sher, 7 Fl. Block B, No. 58, Sec. 1, Min Sheng E. Road, Taipei (TW)

( * ) Notice: Subject to any disclaimer, the term of this patent is extended or adjusted under 35 U.S.C. 154(b) by 0 days.

(21) Appl. No.: 09/854,534

(22) Filed: May 15, 2001

(65) Prior Publication Data

US 2002/0113186 A1 Aug. 22, 2002

(30) Foreign Application Priority Data

Feb. 19, 2001 (CN) ..... 1203616

(51) Int. Cl.[7] ..... A47G 1/10

(52) U.S. Cl. ..... 248/316.5; 248/316.6; 211/124; 206/279; 206/287; 206/289; 206/291

(58) Field of Search ..... 248/309.1, 316.4, 248/316.5, 316.6, 279, 68.1; 211/8, 113, 124; 206/279, 287, 291, 289, 285; 223/1; 24/510, 297, 543

(56) References Cited

U.S. PATENT DOCUMENTS 4,363,388 A * 12/1982 London et al. ..... 206/285
4,618,058 A * 10/1986 Gregg et al. ..... 206/291
4,640,414 A * 2/1987 Mobley et al. ..... 206/287
4,732,270 A * 3/1988 Myers ..... 206/289
4,753,342 A * 6/1988 Pulichino, Jr. ..... 206/291
5,048,785 A * 9/1991 Shaw ..... 248/306
5,400,900 A * 3/1995 Myers ..... 206/289
5,887,710 A * 3/1999 London et al. ..... 206/289
5,944,178 A * 8/1999 Mao ..... 206/289

FOREIGN PATENT DOCUMENTS

EP 0331153 A1 * 2/1989

* cited by examiner

*Primary Examiner*—Anita King
*Assistant Examiner*—Gwendolyn Baxter
(74) *Attorney, Agent, or Firm*—Troxell Law Office PLLC

(57) ABSTRACT

A hanger support comprises a base comprising a vertical projection having a pivotal member at an upper end, a plurality of hanging grooves, a plurality of arc members each alternate with one of the hanging grooves, an upwardly raised tab at one end of the projection, and a lower flat abutted the tab. A pivotal engagement mechanism hinges to the other end of the projection of the base. The engagement mechanism comprises an opening at the free end and a slope on one edge of the opening; and a pair of parallel pad members on the bottom of the engagement mechanism; wherein the engagement mechanism is rotatable to cause the flat to contact the bottom of the engagement mechanism with the tab fastened in the opening by engaging the tab with the slope so that a plurality of hangers hung on the hanging grooves are clamped by the pad members in a locked state of the hanger support device. The fastening/unfastening of a hanger is by simply pivoting the engagement mechanism. Further, garments are neat while stored in a garment bag incorporating the hanger support.

5 Claims, 11 Drawing Sheets

HANGER SUPPORT WITH VERTICALLY DISPOSED GARMENT HANGING GROVES

BACKGROUND OF THE INVENTION

1. Field of the Invention

The present invention relates to hanger supports and more particularly to a hanger support with vertically disposed garment hanging grooves.

2. Description of Related Art

Hanger supports have been widely used for fastening one or more hangers having hung garment(s). However, the conventional designs suffered from several disadvantages. For example, the fastening is not reliable, the structural strength is not sufficient, and the quality is poor. Hence, supported garments are messy in most commercially available hanger supports. Thus, improvement exists.

SUMMARY OF THE INVENTION

It is an object of the present invention to provide a hanger support device comprising a base, a pivotal engagement mechanism, a pin, and a pair of parallel pad members on the bottom of the engagement mechanism wherein the engagement mechanism is rotatable to secure to the base for causing the pad members to clamp on a plurality of hangers hung on the hanging grooves in a locked state of the hanger support device.

It is another object of the present invention to provide a hanger support device wherein the base comprises a plurality of hanging grooves and a plurality of arc members each alternate with one of the hanging grooves so that two adjacent hangers are suitably spaced apart.

It is still another object of the present invention to provide a hanger support device wherein a variety of hangers may be hung on the hanger grooves and clamped by pad members formed of elastomeric material so as to enhance the adaptability of the base.

It is still another object of the present invention to provide a hanger support device wherein the base further comprises an upwardly raised tab and the engagement mechanism comprises an opening at the free end so that the engagement mechanism is rotatable to cause the tab to fasten in the opening in a locked state of the hanger support device.

It is a further object of the present invention to provide a hanger support device further comprising a latching means wherein after the engagement mechanism is covered on the base, the latching means is pivotable to be secured in the locked state of the hanger support device.

To achieve the above and other objects, the present invention provide a hanger support device comprising a base comprising a vertical projection having a pivotal member at an upper end, a plurality of hanging grooves, a plurality of arc members each alternate with one of the hanging grooves, an upwardly raised tab at one end of the projection, a lower flat abutted the tab, and an elongate transverse slot abutted the other end of the projection; a pivotal engagement mechanism hinged to the other end of the projection, the engagement mechanism comprising an opening at the free end and a slope on one edge of the opening; and a pair of parallel pad members on the bottom of the engagement mechanism; wherein the engagement mechanism is rotatable to cause the flat to contact the bottom of the engagement mechanism with the tab fastened in the opening by engaging the tab with the slope so that a plurality of hangers hung on the hanging grooves are clamped by the pad members in a locked state of the hanger support device. By utilizing this hanger support, the fastening/unfastening of a hanger is by simply pivoting the engagement mechanism. Further, garments are neat while stored in a garment bag incorporating the hanger support.

The above and other objects, features and advantages of the present invention will become apparent from the following detailed description taken with the accompanying drawings.

DETAILED DESCRIPTION OF THE PREFERRED EMBODIMENTS

Figure 1:
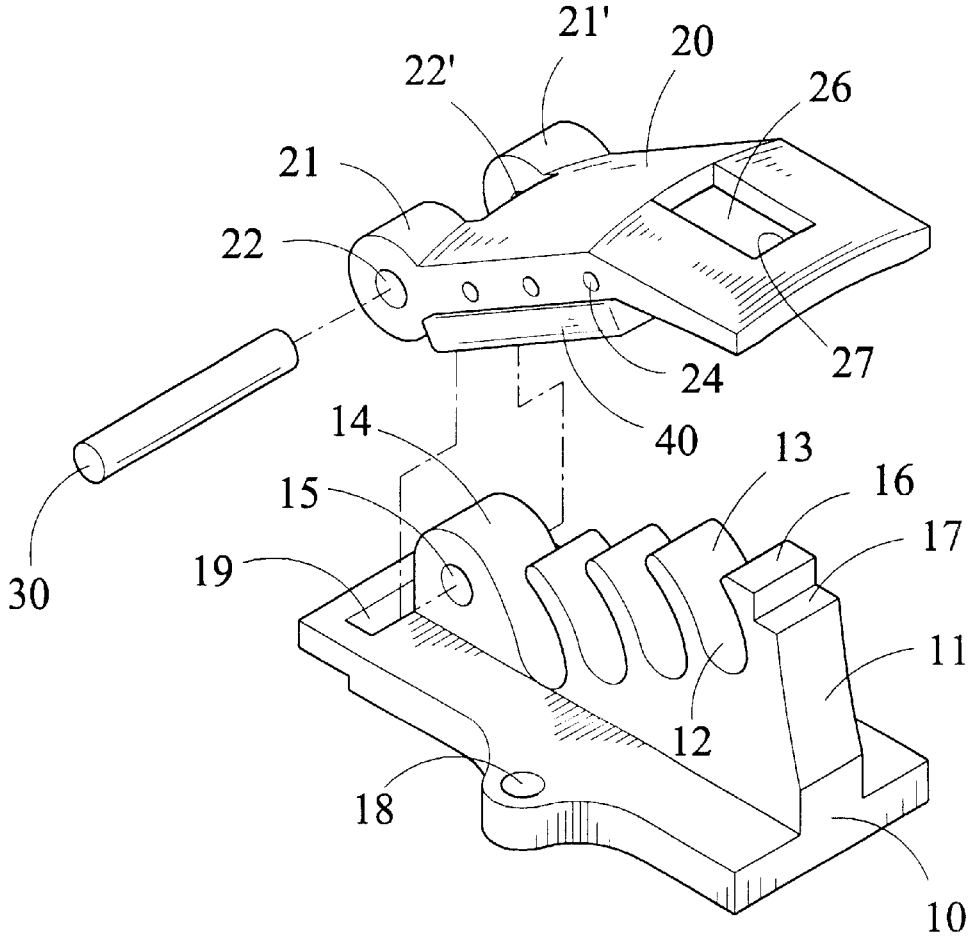
FIG. 1 is an exploded view of a first preferred embodiment of hanger support with vertically disposed garment hanging grooves according to the invention.
Figure 2:
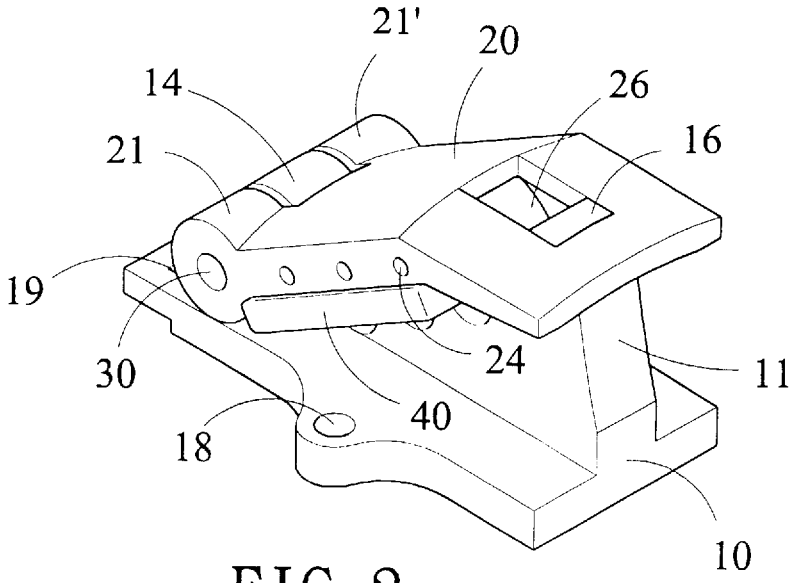
FIG. 2 perspective view of FIG. 1 where hanger support is locked.
Figure 3:
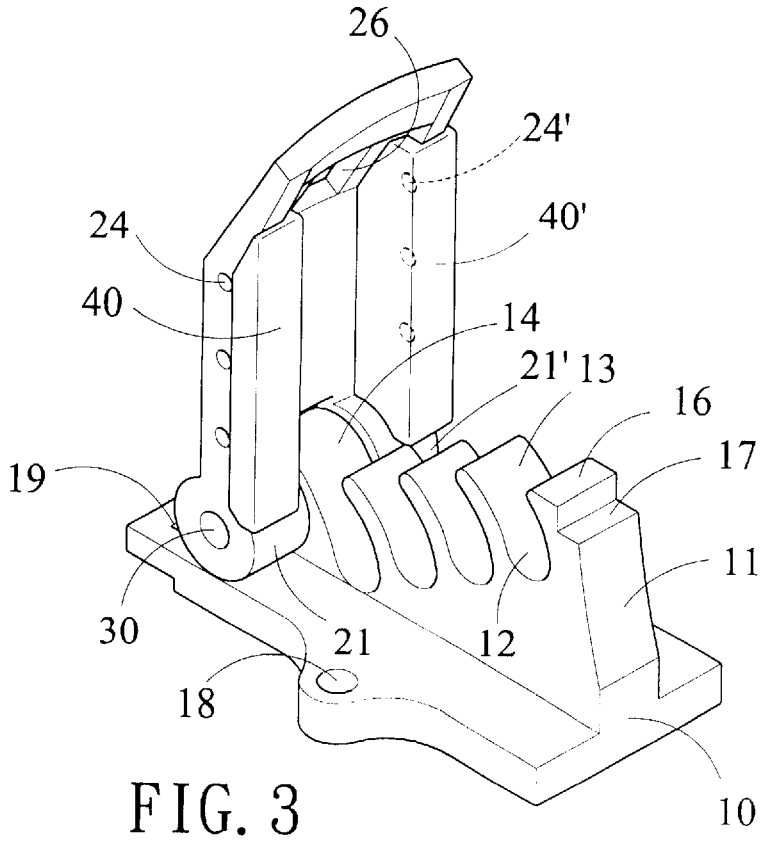
FIG. 3 is a view similar to FIG. 2 where hanger support is unlocked.

FIGS. 1 to 3, show a first preferred embodiment of hanger support constructed in accordance with the invention comprising a base 10, a pivotal engagement mechanism 20, a pin 30, and a pair of parallel pad members 40 and 40'. Each of above components is detailed below. Base 10 comprises a vertical projection 11 having one end shorter than the other end (i.e., the lower portion is wider than the higher portion), a plurality of hanging grooves 12, a plurality of arc members 13 each alternate with hanging groove 12, a pivot section 14 at one end of projection 11, a transverse hole 15 passed through pivot section. 14, an upward raised tab 16 at the other end of projection 11, a lower flat 17 abutted the tab 16, a pair of holes 18 on two opposite sides of projection 11, and an elongate transverse slot 19 abutted the first pivot section 14. Pivotal engagement mechanism 20 comprises two second pivot sections 21 and 21' at one end, two holes 22 and 22' passed through the second pivot sections 21 and 21' respectively, a plurality of apertures 24 and 24' on either side for feeding liquid elastomeric material into pad members 40 and 40' which are provided on the bottom of pivotal engagement mechanism 20, a rectangular opening 26 at the other end, and a slope 27 on one edge of opening 26. Pin 30 is inserted through hole 22 of second pivot section 21, hole 15 of first pivot section 14 of base 10, and hole 22' of second pivot section 21' (i.e., formed as a hinge) to pivotably and firmly secure pivotal engagement mechanism 20 to base 10.

Figure 4A:
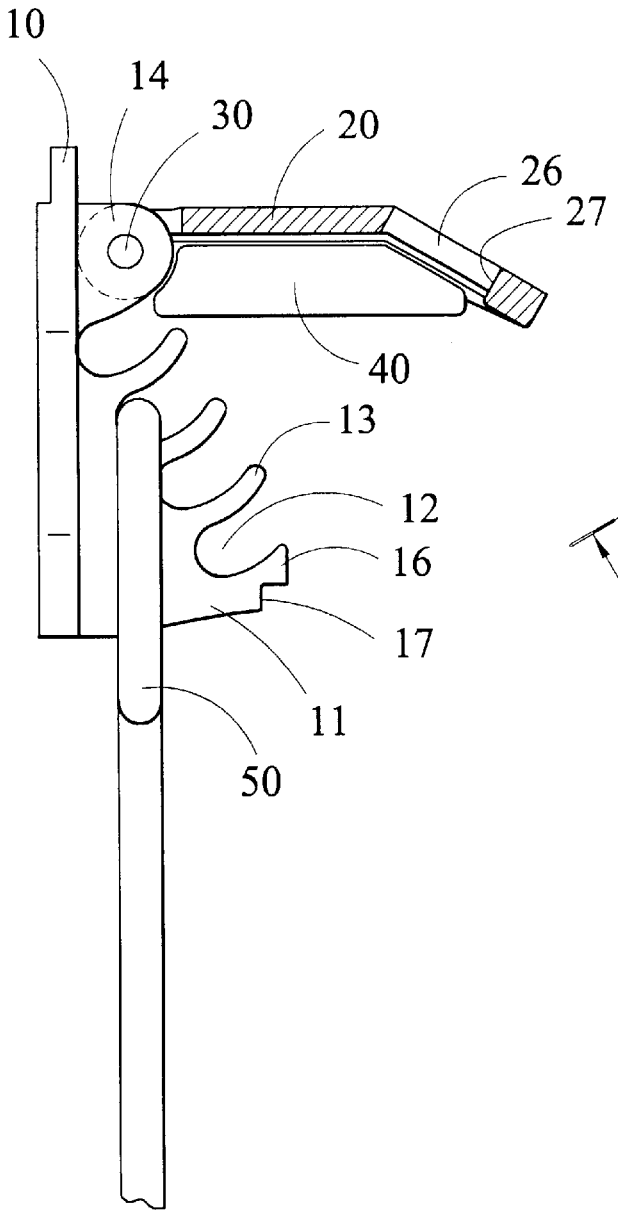
FIG. 4A is a sectional view of FIG. 3 where a hanger is hung but unlocked.
Figure 4B:
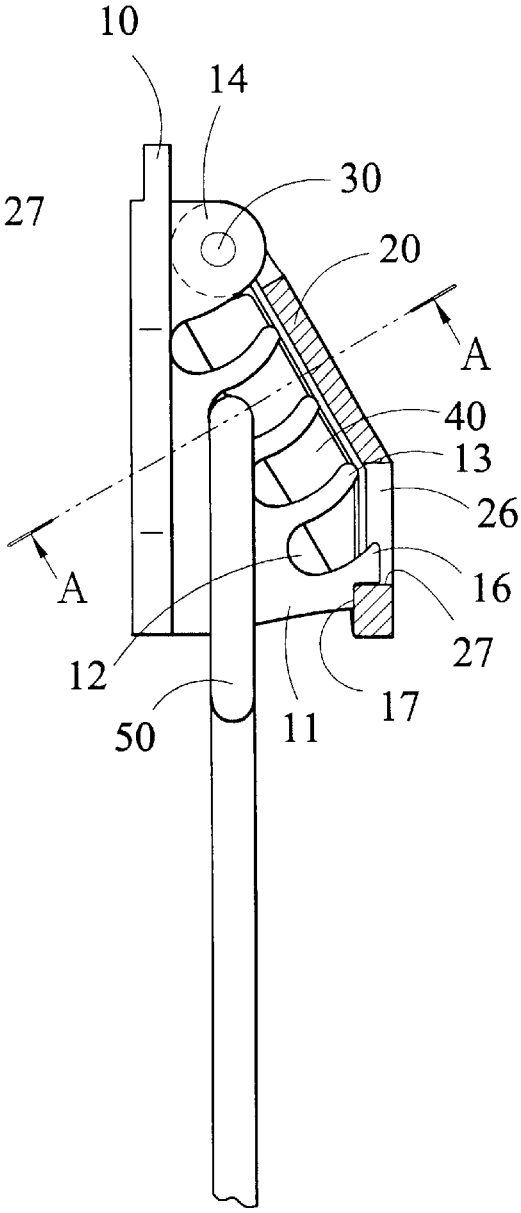
FIG. 4B is a sectional view of FIG. 2 where a hanger is hung and locked.
Figure 5:
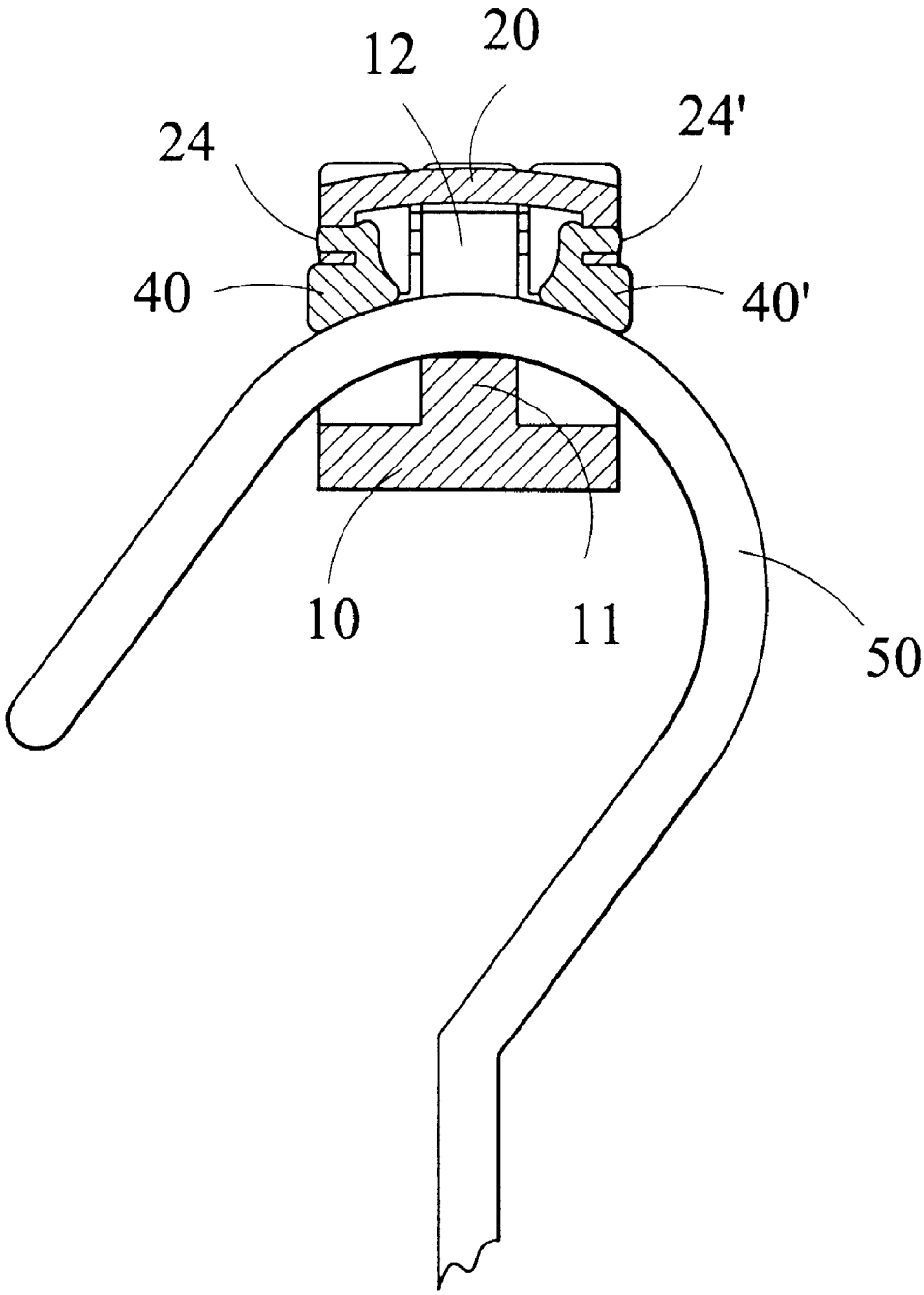
FIG. 5 is a sectional view taken along line A—A of FIG. 4B.

Referring to FIGS. 4A, 4B and 5, the locking operation of hanger support is detailed below. First, put hook portion of a hanger 50 on one hanging groove 12 when the engagement mechanism 20 is open (FIG. 4A). Then pivot the engagement mechanism 20 toward base 10 about pin 30 until flat 17 contacts the bottom of pivotal engagement mechanism 20 with tab 16 fastened in opening 26 by snugly engaging tab 16 with slope 27 (FIG. 4B). This is a locked state of hanger support. At the same time, hanger 50 is clamped by pad members 40 and 40'. Thus, hanger 50 is flexibly secured. Also, hook portions of a plurality of hangers 50, each having a diameter different from the other, may be fastened by pad members 40 and 40' since the provision of pad members 40 and 40' formed of elastomeric material as stated above.

Figure 6:
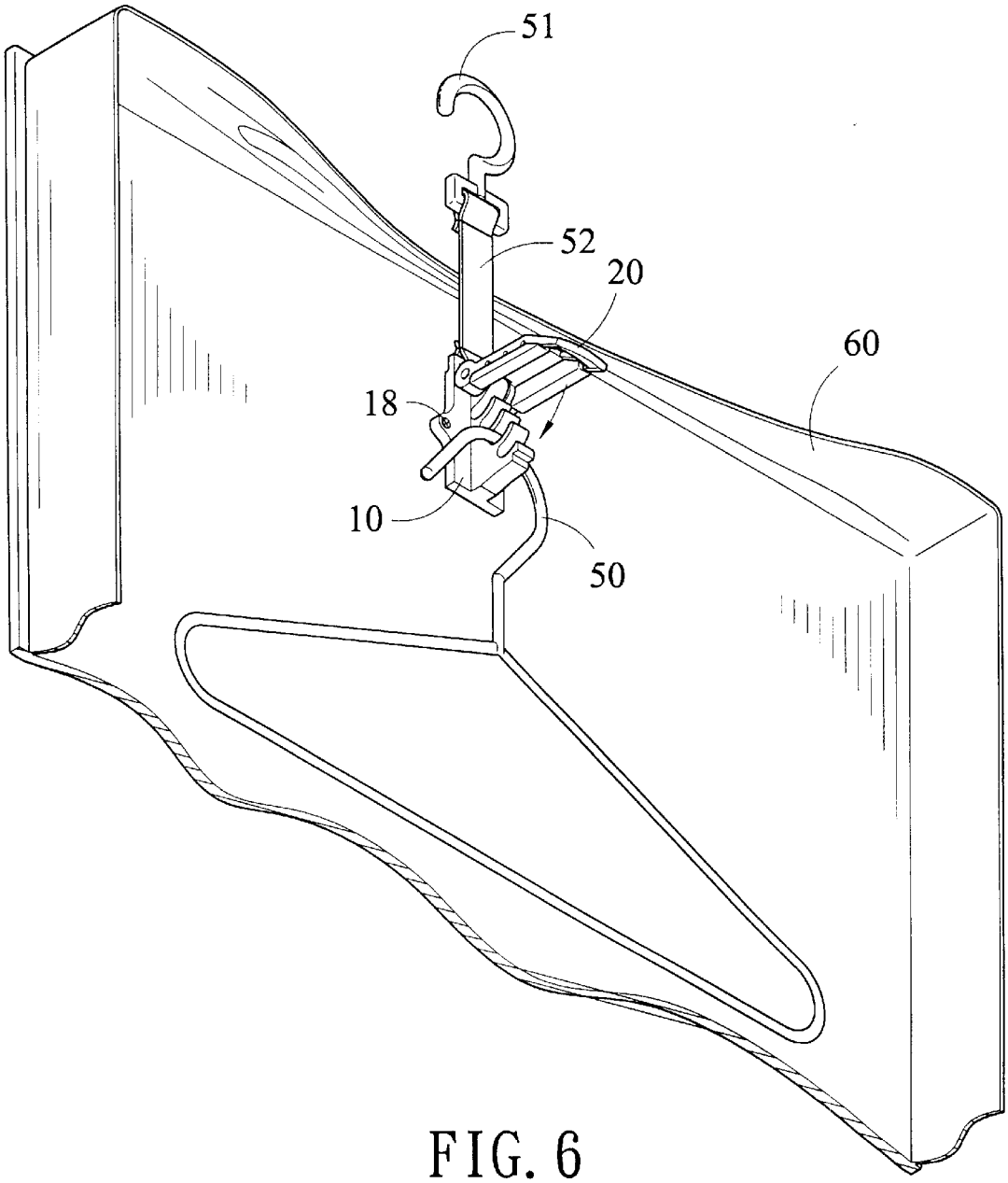
FIG. 6 is an environmetal perspective view of a hanger hung on but not locked by the FIG. 1 hanger support which is mounted on a garment bag and secured to a hook by a strap.
Figure 7:
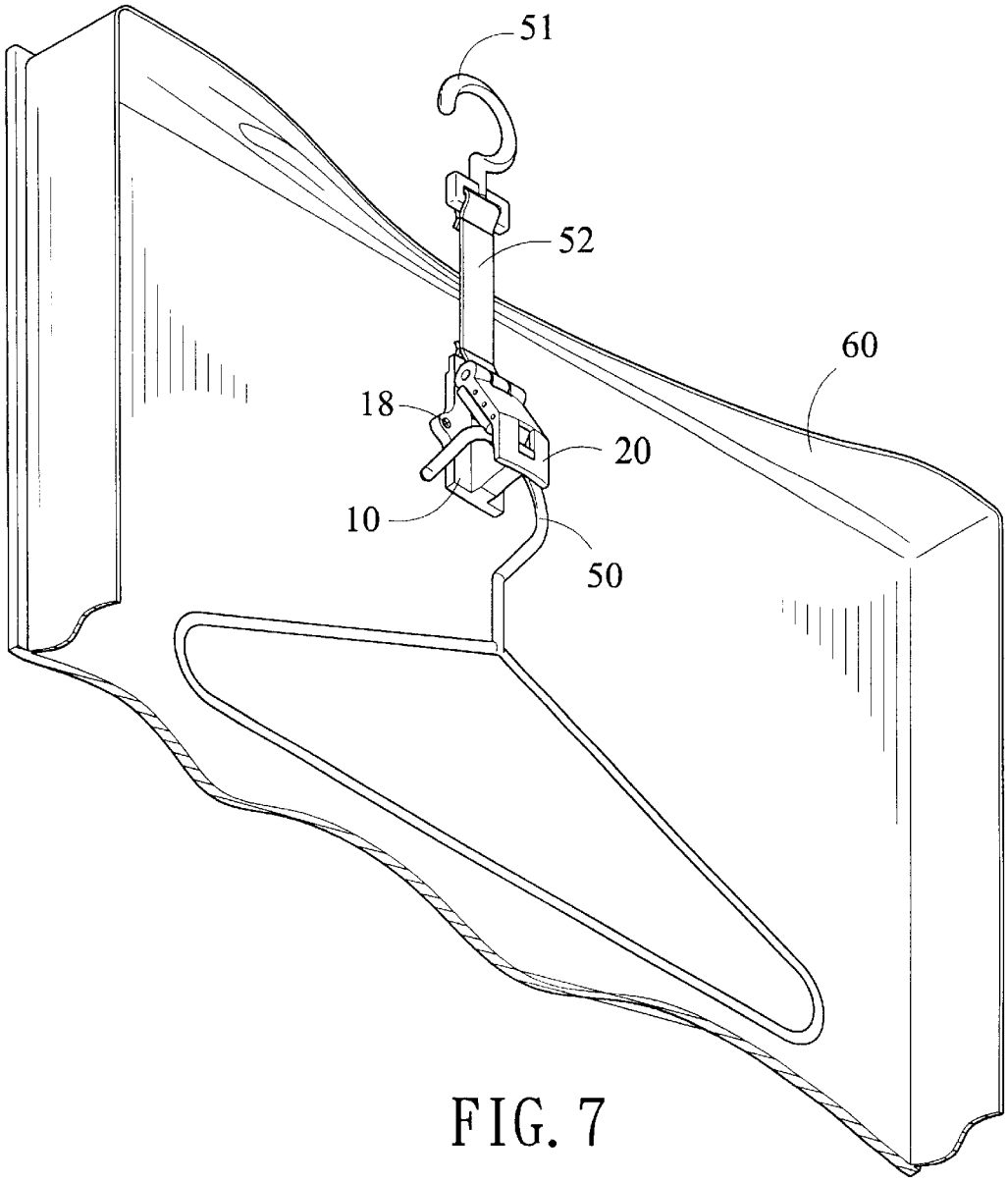
FIG. 7 is view similar to FIG. 6 where hanger is locked.

Referring to FIGS. 6 and 7, a hanger 50 is hung on the hanger support which is mounted on a garment bag 60 by driving screws through holes 18 thereinto. Further, a strap 52 has one end looped through the bottom slit of a hook 51 and the other end looped through slot 19. Hence, a plurality of hangers 50 each having a hung garment may be secured in hanging grooves 12. Further, user may place garment bag 60 on a suitable place by hanging the hook 51 on a support. It is noted that the distance between the valley (i.e., the place where hanger 50 is supported) of one hanging groove 12 and the surface of base 10 is increased downwardly. That is, the distance between the valley of the topmost hanging groove 12 and the surface of base 10 is smaller than the distance between the valley of a next topmost hanging groove 12 and the surface of base 10. Thus, there is a uniform gap between two adjacent hung hangers 50. Hence, adjacent hung garments may not interfere each other. As a result, garments are neat while stored in garment bag 60.

Figure 8:
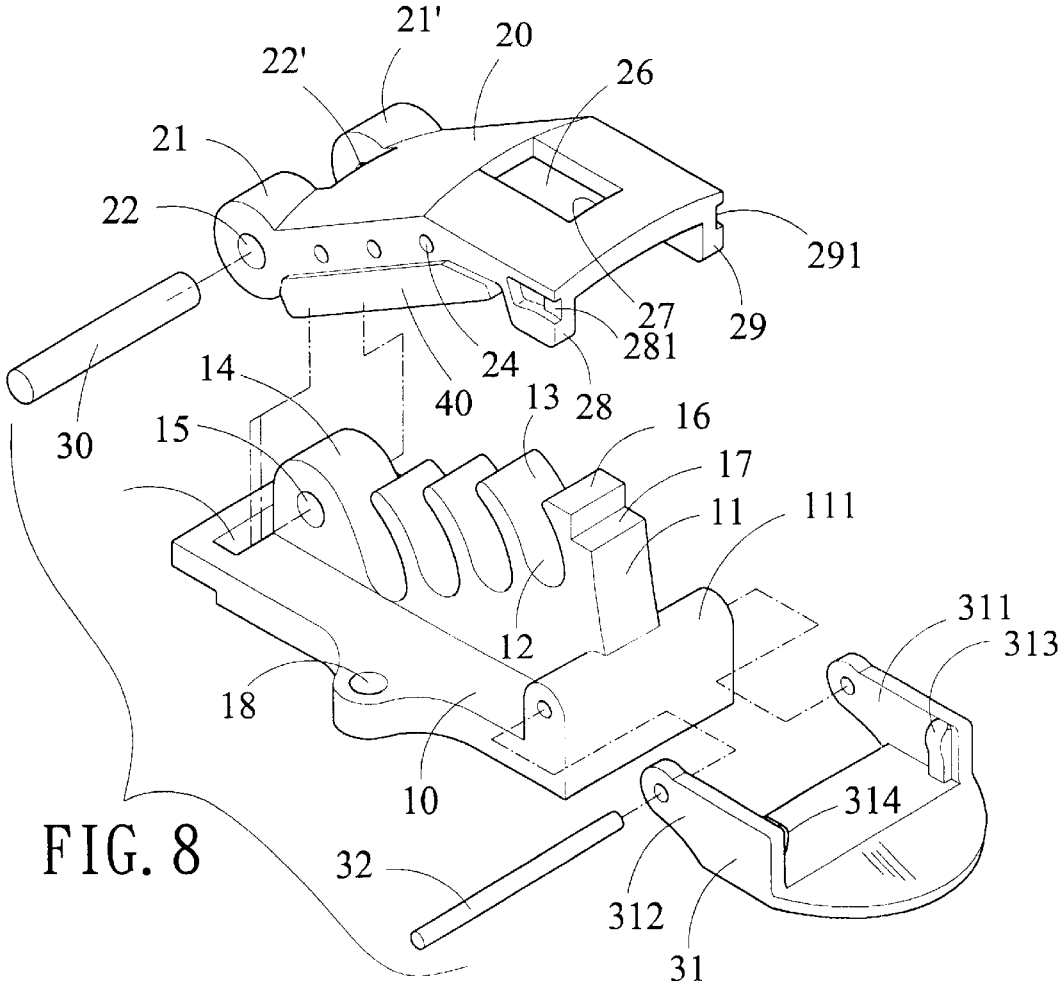
FIG. 8 is an exploded view of a second preferred embodiment of hanger support with vertically disposed garment hanging grooves according to the invention.
Figure 9:
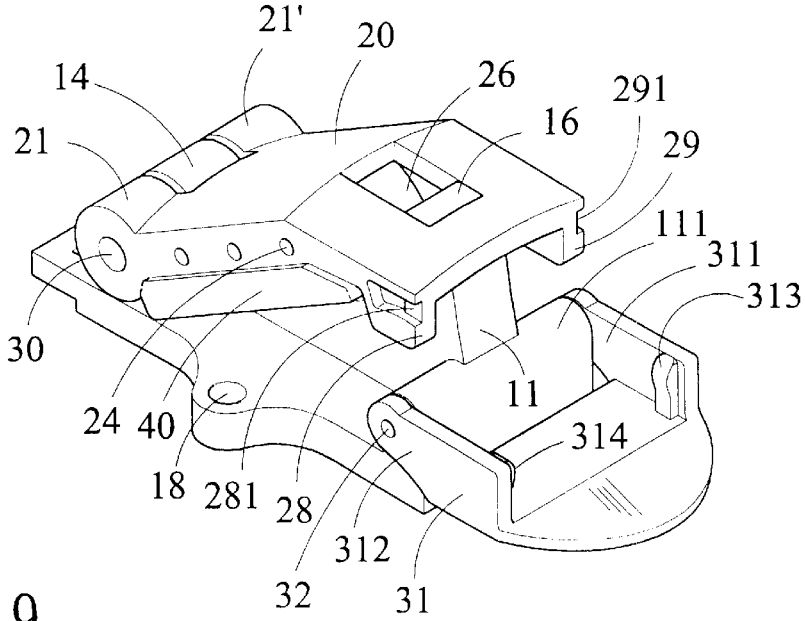
FIG. 9 is a perspective view of FIG. 8 where pivotal engagement mechanism is covered on base but hanger support is unlocked.
Figure 10:
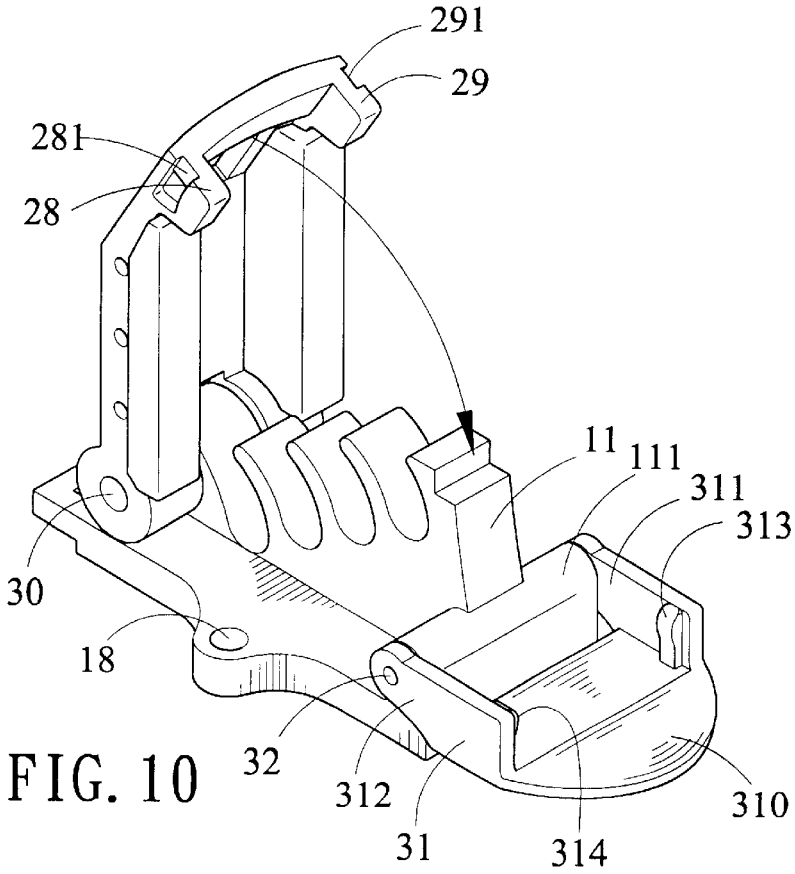
FIG. 10 is a view similar to FIG. 9 where pivotal engagement mechanism is open to expose hanging grooves.
Figure 11:
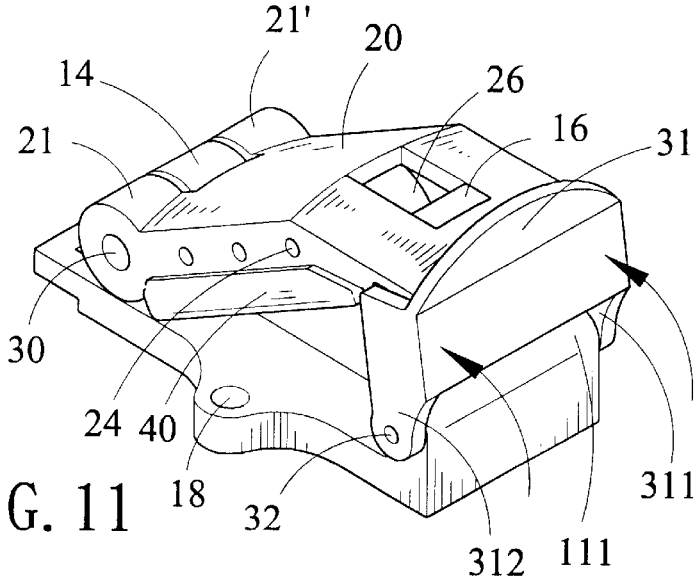
FIG. 11 is a view similar to FIG. 9 where hanger support is locked.
Figure 12:
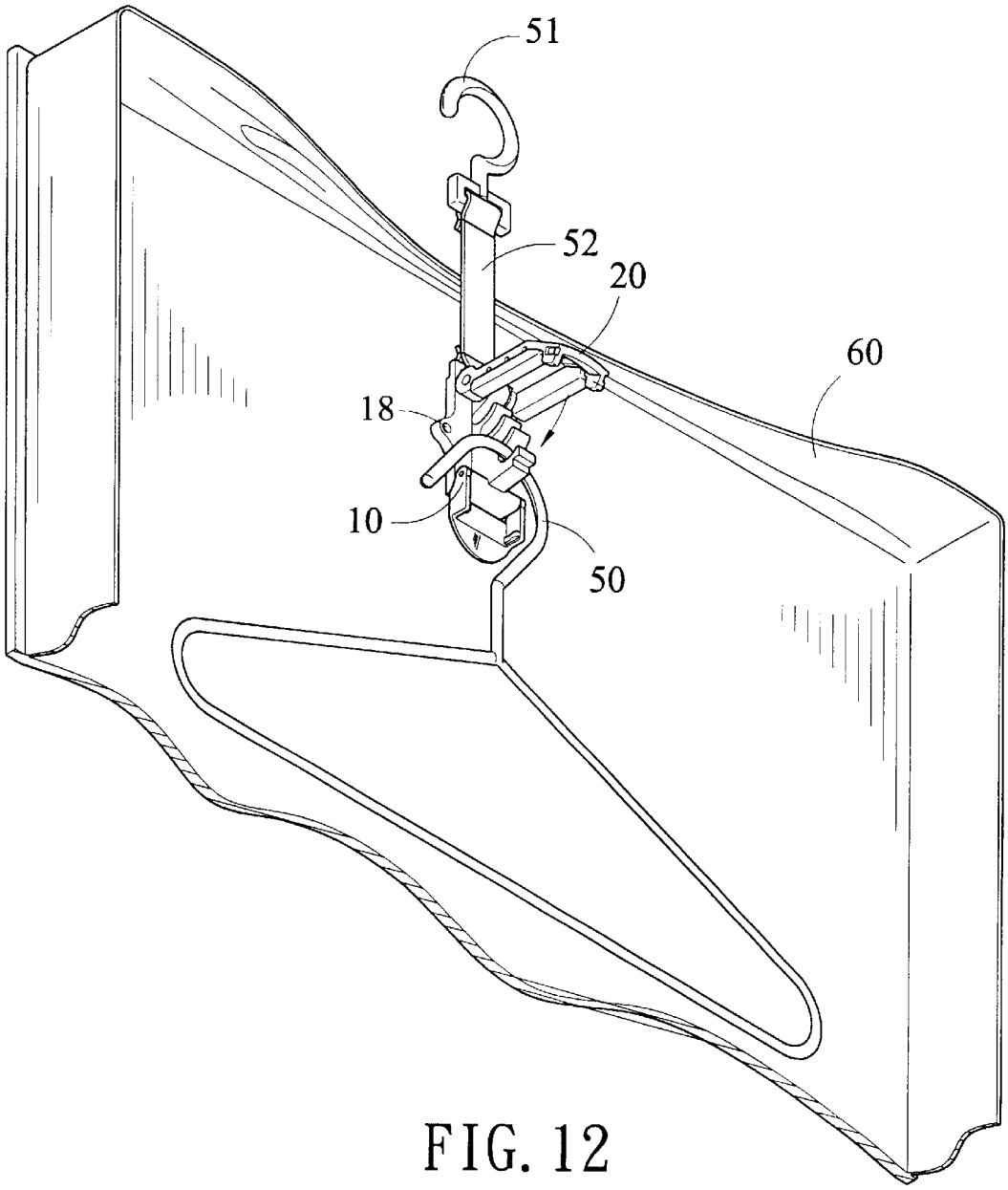
FIG. 12 is an environmental perspective view of a hanger hung on but not locked by the FIG. 8 hanger support which is mounted on a garment bag and secured to a hook by a strap.
Figure 13:
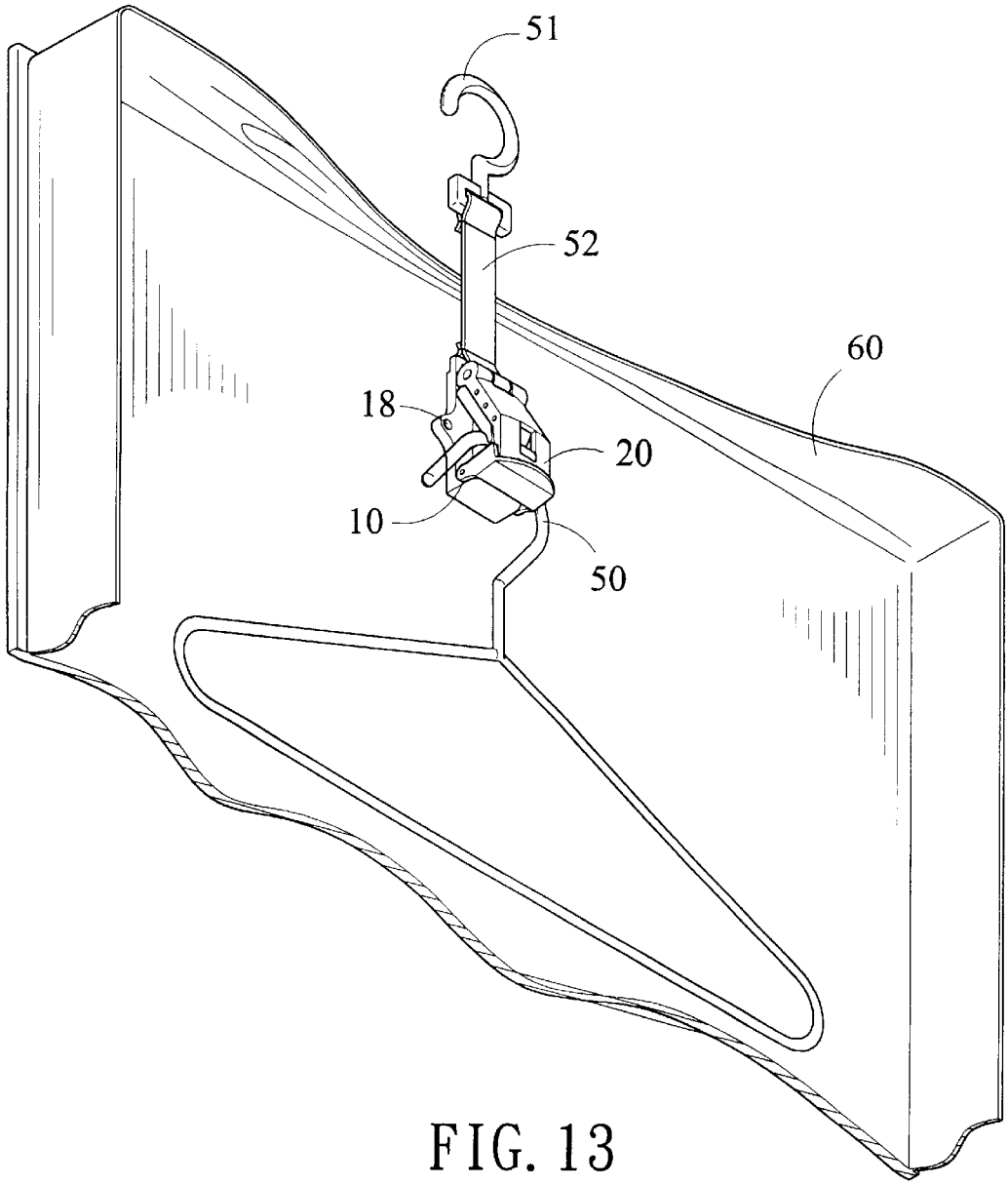
FIG. 13 is view similar to FIG. 12 where hanger is locked.

FIGS. 8 and 9, show a second preferred embodiment of hanger support constructed in accordance with the invention. The differences between first and second embodiment are as below. As shown, a latching device 31 is provided and comprises a body 310 having two opposite arms 311 and 312 extending from the body, at free ends of two arms 311 and 312 each having a pivots hole 3110 and 3120 and two protuberances 313 and 314 facing each other provided inside the fixed end of arms 311 and 312. A pivot section 111 for the latching device 31 is provided on the other end of base 10. A pin 32 is inserted through the pivot hole 3120 of arm 312, pivot section 111, and the pivot hole 3110 of arm 311 to form a hinge. Further, two pegs 28 and 29 are downwardly extended from the front bottom sides of engagement mechanism 20. Two recesses 281 and 291 are provided on pegs 28 and 29 respectively.

Referring to FIGS. 10 to 13, the locking operation of hanger support is detailed below. After engagement mechanism 20 is pivoted to cover on base 10, pivot the latching device 31 about pin 32 until protuberances 313 and 314 are firmly inserted into recesses 281 and 291. This may also achieve the same function of the first embodiment of the present invention mentioned above and further enhance the fairly fastening of engagement mechanism 20 and base 10.

Figure 14:
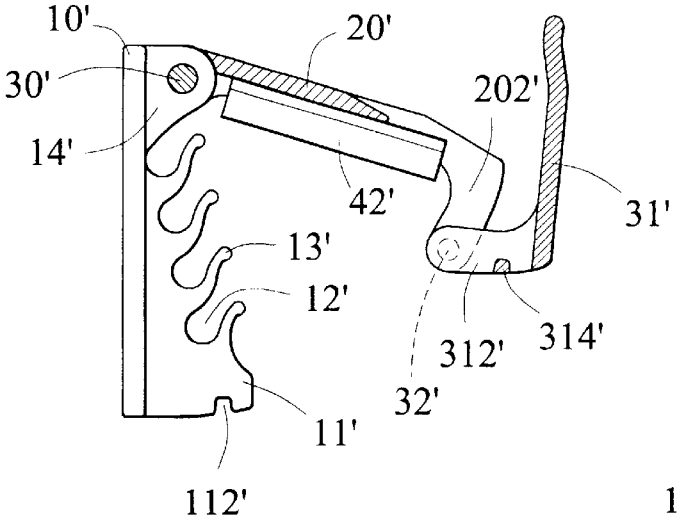
FIG. 14 is a sectional view of a third preferred embodiment of hanger support with vertically disposed garment hanging grooves according to the invention where hanger support is unlocked.
Figure 15:
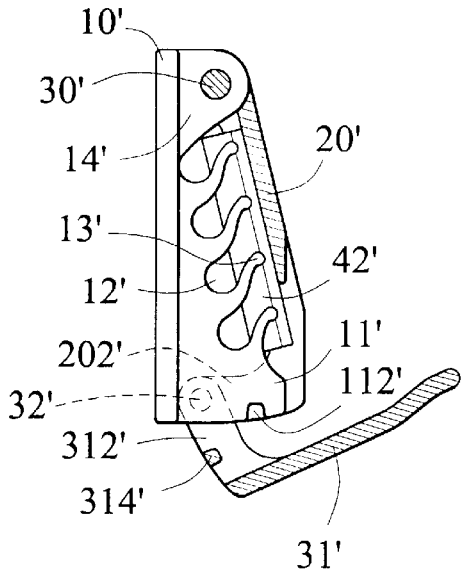
FIG. 15 is a view similar to FIG. 14 where pivotal engagement mechanism is covered on base but hanger support is unlocked.
Figure 16:
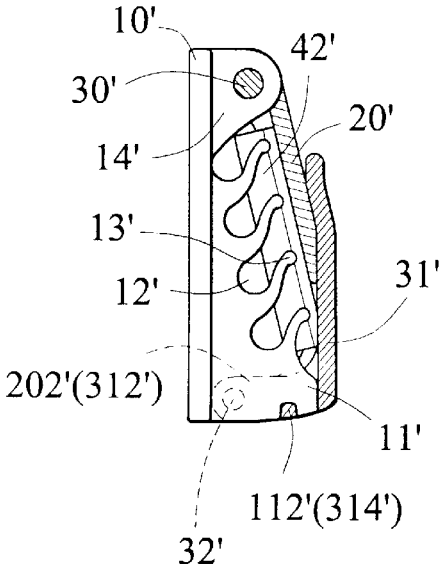
FIG. 16 is a view similar to FIG. 14 where hanger support is locked.

Referring to FIGS. 14 to 16, there is shown a third preferred embodiment of hanger support constructed in accordance with the invention. The differences between first and second embodiment are as below. As shown, two arms 312' are further provided on latching device 31', two arms 202' are further provided at the free end of engagement mechanism 20, latching device 31' is hinged on engagement mechanism 20 after by a pin 32' pivotably securing arms 312' to arms 202', a transverse locking bar 314' is coupled between arms 312' of latching device 31', and a transverse locking trough 112' is provided on the bottom of base 10. The locking bar 314' will be secured into the locking through 112' in a locked state of the hanger support when one or more hangers are hung one hanging grooves 12'. This may also attain the same purpose and function as mentioned above and enhance the well fastening of engagement mechanism 20' and base 10'.

While the invention herein disclosed has been described by means of specific embodiments, numerous modifications and variations could be made thereto by those skilled in the art without departing from the scope and spirit of the invention set forth in the claims.

What is claimed is:

1. A hanger support device comprising:

a base comprising a vertical projection having a pivotal member at an upper end;

a plurality of hanging grooves;

a plurality of arc members each alternate with one of said hanging grooves; and an upwardly raised tab at one end of said projection, a lower flat abutted said tab;

a pivotal engagement mechanism having an upper end hinged to said pivotal member at the end of said projection, said engagement mechanism comprising an opening at a free end thereof and a slope on an edge of said opening; and a pair of parallel pad members on a bottom of said engagement mechanism;

wherein the engagement mechanism is rotatable to cause said lower flat of said base to contact a bottom of said engagement mechanism with said upwardly raised tab fastened in said opening by engaging said tab with said slope so that a hanger hung on said hanging grooves is clamped by said pad members in a locked state of said hanger support device.

2. The hanger support device of claim 1, wherein each of said pad members is formed of elastomeric material.

3. The hanger support device of claim 1, further comprising a latching means having a body which has two opposite arms extending from the body and two facing protuberances inside fixed ends of said arms, a pivot section at an end of said base, a pin inserted through said arms, and said pivot section, to form a hinge, so as to enable said latching means to hinge to said pivot section of said base, two opposite pegs extended downwardly from one end said engagement mechanism, and two recesses formed on said pegs respectively wherein after said engagement mechanism is covered on said base, said latching means is pivotable to insert said protuberances into said recesses in said locked state of said hanger support device.

4. A hanger support device comprising:

a base comprising a vertical projection having a pivotal member at an upper end;

a plurality of hanging grooves;

a plurality of arc members each alternate with one of said hanging grooves; and a transverse locking trough on a bottom of said base;

a pivotal engagement mechanism having an upper end hinged to the pivotal member at the upper end of said vertical projection, said engagement mechanism comprising two arms at a lower end, thereof;

a latching means comprising two arms being pivotally secured to said arms of said engagement mechanism to form a hinge and a transverse locking bar formed therebetween; and a pair of parallel pad members on said bottom of said engagement mechanism;

wherein after said engagement mechanism is rotated to cover on said base, said latching means is rotatable relative to said engagement mechanism for inserting said transverse locking bar into said transverse locking trough so that a hanger hung on said hanging grooves is clamped by said pad members in a locked state of said hanger support device, and wherein another end of said projection is abutted with an elongate transverse slot for connecting a strap or tape.

5. The hanger support device of claim 4, wherein each of said pad members is formed of elastomeric material.

* * * * *